US009821441B2

(12) United States Patent
Chen

(10) Patent No.: US 9,821,441 B2
(45) Date of Patent: Nov. 21, 2017

(54) RATCHET WRENCH

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 8 days.

(21) Appl. No.: 15/168,094

(22) Filed: May 30, 2016

(65) Prior Publication Data

US 2016/0271762 A1 Sep. 22, 2016

Related U.S. Application Data

(63) Continuation-in-part of application No. 14/179,570, filed on Feb. 13, 2014, now abandoned.

(51) Int. Cl.
*B25B 13/46* (2006.01)
*B25B 23/00* (2006.01)

(52) U.S. Cl.
CPC ..... *B25B 13/463* (2013.01); *B25B 13/465* (2013.01); *B25B 13/466* (2013.01); *B25B 23/0035* (2013.01)

(58) Field of Classification Search
CPC . B25B 13/463; B25B 23/0035; B25B 13/465; B25B 15/04; B25B 13/466
See application file for complete search history.

(56) References Cited

U.S. PATENT DOCUMENTS 2,107,568 A * 2/1938 Haist ..... B25B 13/463 192/43.1
4,030,384 A * 6/1977 Newman ..... B25B 13/466 81/58.3
6,164,167 A * 12/2000 Chen ..... B25B 13/463 81/63
6,282,991 B1 * 9/2001 Hu ..... B25B 13/463 81/60
6,516,690 B2 * 2/2003 Chen ..... B25B 13/463 192/46
6,789,449 B2 * 9/2004 Liu ..... B25B 13/463 192/43
6,945,141 B2 * 9/2005 Hu ..... B25B 13/463 81/63
7,047,842 B1 * 5/2006 Lee ..... B25B 13/463 81/63
7,178,429 B2 * 2/2007 Lin ..... B25B 13/463 81/58
7,353,735 B2 * 4/2008 Patel ..... B25B 13/463 81/60

(Continued)

*Primary Examiner* — Larry E Waggle, Jr.
*Assistant Examiner* — Danny Hong
(74) *Attorney, Agent, or Firm* — Rosenberg, Klein & Lee

(57) ABSTRACT

A ratchet wrench includes a wrench body, a ratchet gear, a pawl and a switch assembly. The pawl has a central tooth, multiple first sub teeth and multiple second sub teeth in a concave surface thereof. Each of the first sub teeth and the second sub teeth has an inner side face abutting against opposing tooth face of the ratchet gear and an outer side face spaced apart from opposing tooth face of the ratchet gear. The first sub teeth and the second sub teeth are located symmetrical relative to the central tooth. The center of the concave surface of the pawl and the center of the ratchet gear are located on a common line that passes through the center of the central tooth of the pawl. The switch assembly is movably disposed in the head of the ratchet wrench for driving the pawl to engage with the ratchet gear.

5 Claims, 7 Drawing Sheets

(56) References Cited

U.S. PATENT DOCUMENTS

| | | | | |
|---|---|---|---|---|
| 2006/0123954 | A1* | 6/2006 | Arnold | B25B 13/463 81/63 |
| 2013/0213190 | A1* | 8/2013 | Chen | B25B 1/02 81/63.2 |
| 2015/0224631 | A1* | 8/2015 | Chen | B25B 13/463 81/63.2 |

* cited by examiner

RATCHET WRENCH

The present invention is a Continuation-In-Part application of applicant's former patent application Ser. No. 14/179,570, filed on Feb. 13, 2014.

BACKGROUND OF THE INVENTION

1. Field of the Invention
2. Description of Related Art

A conventional ratchet wrench comprises a handle and a head at one end of the handle. The head has a receive hole, a first chamber and a second chamber. A driving member is received in the receive hole of the head for free rotating. The driving member has a teeth portion at outer surface thereof. A pawl has a teeth portion at one side thereof and a driven portion at the other side thereof. The pawl is received in the first chamber of the head while the teeth portion of the pawl meshes with the teeth portion of the driving member. A switch device has a body and a turning piece. The body of the switch device is received in the second chamber of the head and movable between a first position and a second position. The body has an elastic driving device disposed therein to be against the driven portion of the pawl.

As described above, the pawl is configured to engage with the driving member to prevent the driving member from being rotated reversely. However, the teeth portion of the pawl of the conventional ratchet wrench is going to be fully engaged with the teeth portion of the driving member, and that requires higher standard of machining. Furthermore, the teeth portion of the pawl of the conventional ratchet wrench and the teeth portion of the driving member are easily worn out. Besides, the teeth portion may be collapsed easily.

US 2003/0150299 to Chen and US 2004/0083860 to Arnold et al. disclose a ratchet wrench, wherein the teeth of the pawl of the ratchet wrench of Arnold et al. has a specific arrangement relative to the teeth of the gear ring when the pawl is shifted to either of two ends of the compartment in which the pawl is located, as disclosed in FIGS. 4A and 4C. Specifically, when the pawl is shifted to the right end of the compartment, a radial distance is formed between the left end of the pawl and the gear ring. Similarly, when the pawl is shifted to the left end of the compartment, another radial distance is formed between the right end of the pawl and the gear ring. By this arrangement, the pawl is easily shifted its direction and reduces wearing. In order to achieve the radial distance between either of the two ends of the pawl and the gear ring, the shape or curvature of the pawl needs to be precisely machined, and the potential manufacturing cost is increased.

The present invention has arisen to mitigate and/or obviate the disadvantages of the conventional ratchet wrench.

SUMMARY OF THE INVENTION

The main objective of the present invention is to provide an improved ratchet wrench.

To achieve the objective, a ratchet wrench comprises a wrench body, a ratchet gear, a pawl and a switch assembly. The wrench body has a head at one end thereof, the head having a cavity, a first compartment and a second compartment therein, the first compartment intercommunicating the cavity and the second compartment. The ratchet gear is rotatably disposed in the cavity of the wrench body and defines a plurality of ratchet teeth, each of the ratchet teeth defining two opposite tooth faces. The pawl is movably received in the first compartment of the wrench body, and defines a central tooth, a plurality of first sub teeth and a plurality of second sub teeth in a concave surface on a front side thereof. The first sub teeth and the second sub teeth are disposed at opposite sides of the central tooth. The curvature of the concave surface of the pawl is defined such that the first sub teeth and the second sub teeth are located symmetrical relative to the central tooth. The center of the concave surface of the pawl and the center of the ratchet gear are located on a common line that passes through the center of the central tooth of the pawl. The central tooth is fully engaged with two adjacent ratchet teeth of the ratchet gear, and two side faces of the central tooth respectively abuts against opposing tooth faces of the two adjacent ratchet teeth. Each of the first and second sub teeth defines an inner side face closer to the central tooth and an outer side face opposite to the inner side face. The inner side face abuts against opposing tooth face of the ratchet gear; besides, the outer side face and opposing tooth face of the ratchet gear are spaced apart in a distance. The switch assembly is movably disposed in the second compartment of the wrench body for driving the pawl to engage with the ratchet gear.

Furthermore, the pawl defines at a top thereof a concave surface of a curvature corresponding to the ratchet gear and a recess corresponding to the switch assembly. Specifically, the inner side faces of the first and second sub teeth are slightly larger than the outer side faces of the first and second sub teeth respectively. Moreover, the switch assembly has a switch lever and an elastic driving member; and the switch lever is operable to have the elastic driving member abut against a wall of the recess of pawl for selectively driving the pawl to engage with the ratchet gear and to control an active direction of the ratchet gear.

Further benefits and advantages of the present invention will become apparent after a careful reading of the detailed description with appropriate reference to the accompanying drawings.

DETAILED DESCRIPTION OF THE INVENTION

Figure 1:
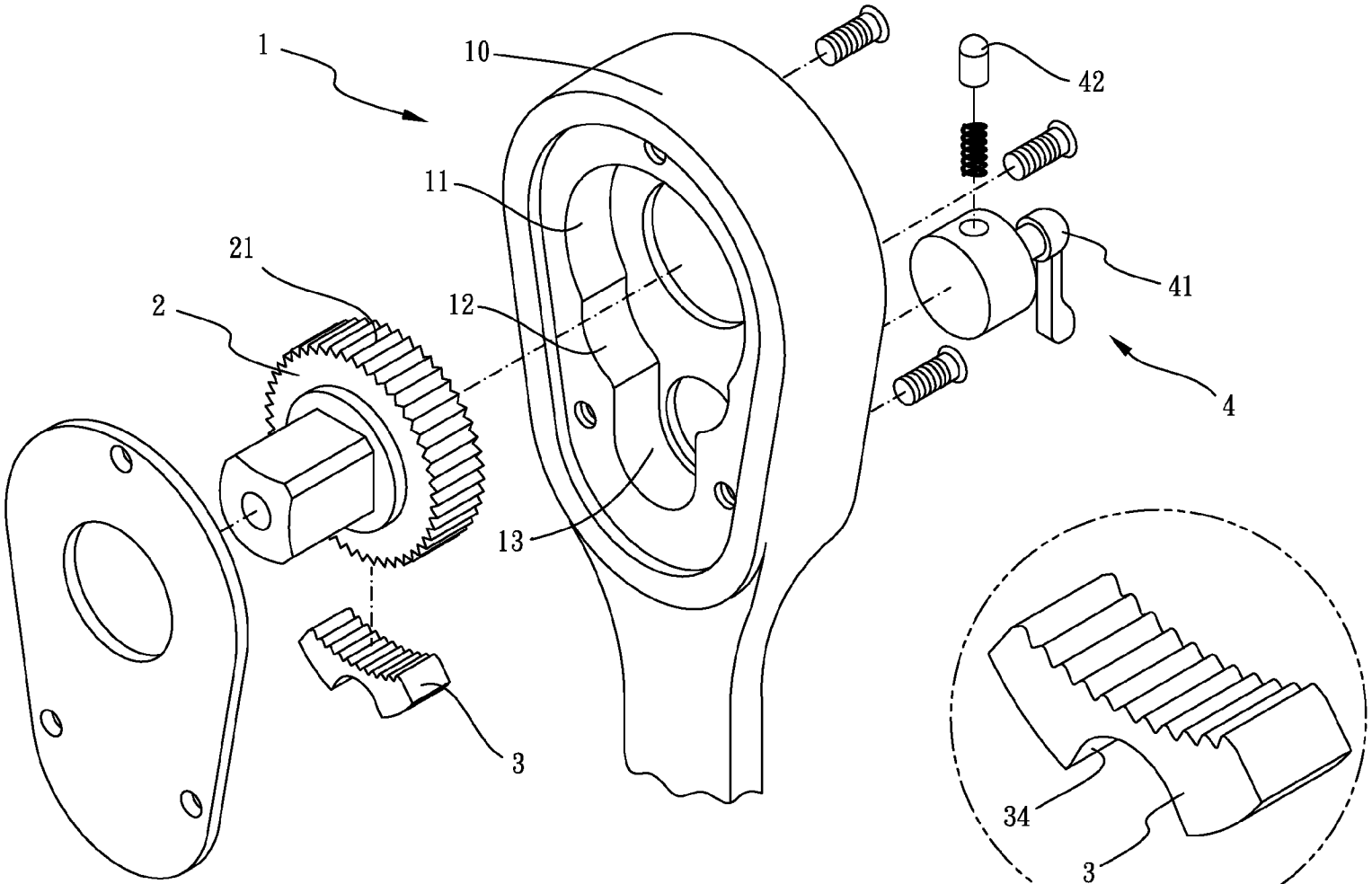
FIG. 1 is an exploded perspective view of a ratchet wrench of the present invention.
Figure 2:
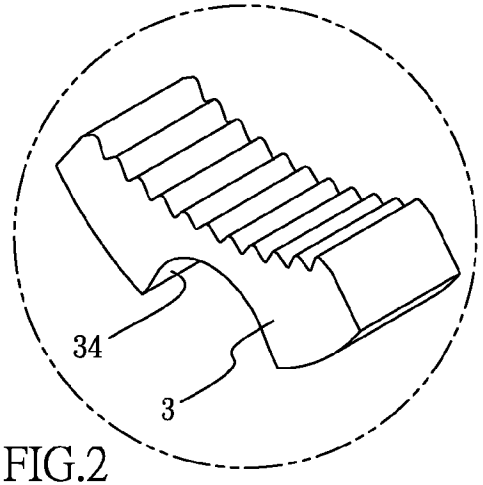
FIG. 2 is an enlarged view of the pawl of the ratchet wrench shown in FIG. 1.
Figure 3:
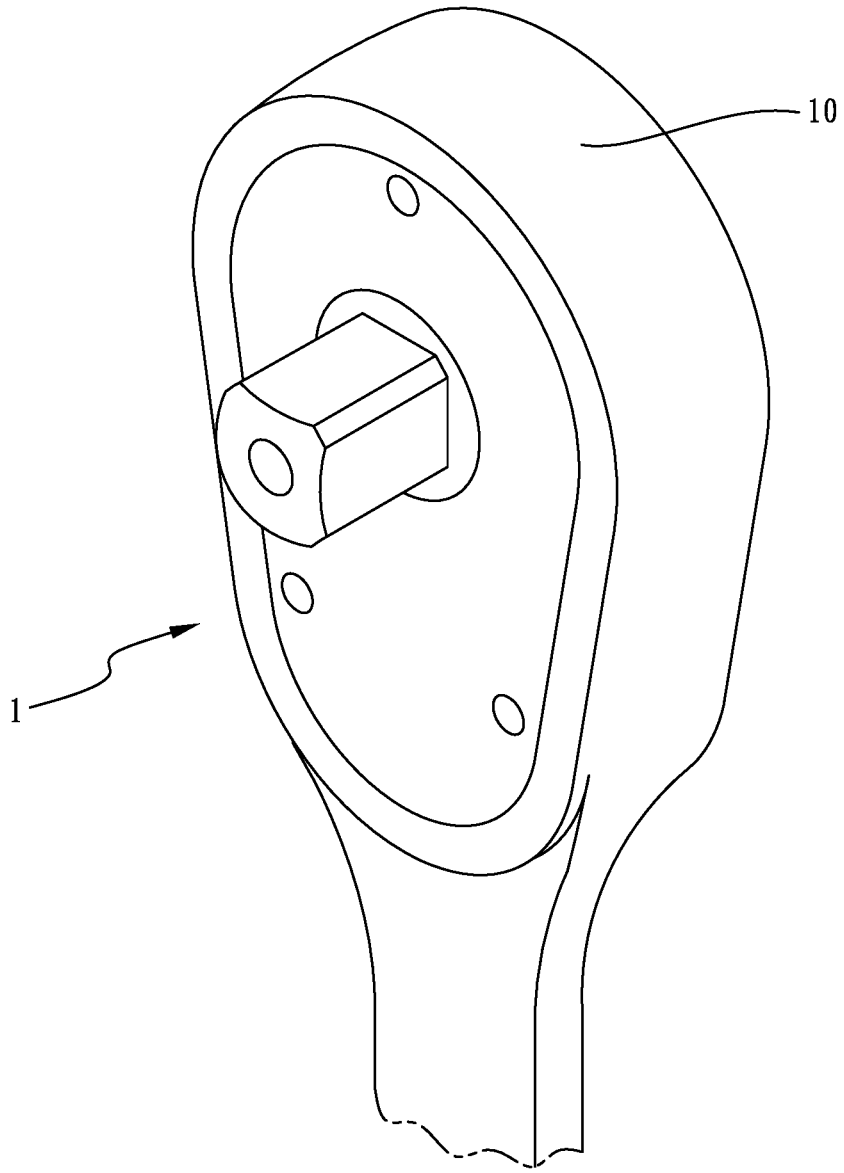
FIG. 3 is a perspective view of the ratchet wrench of the present invention.
Figure 4:
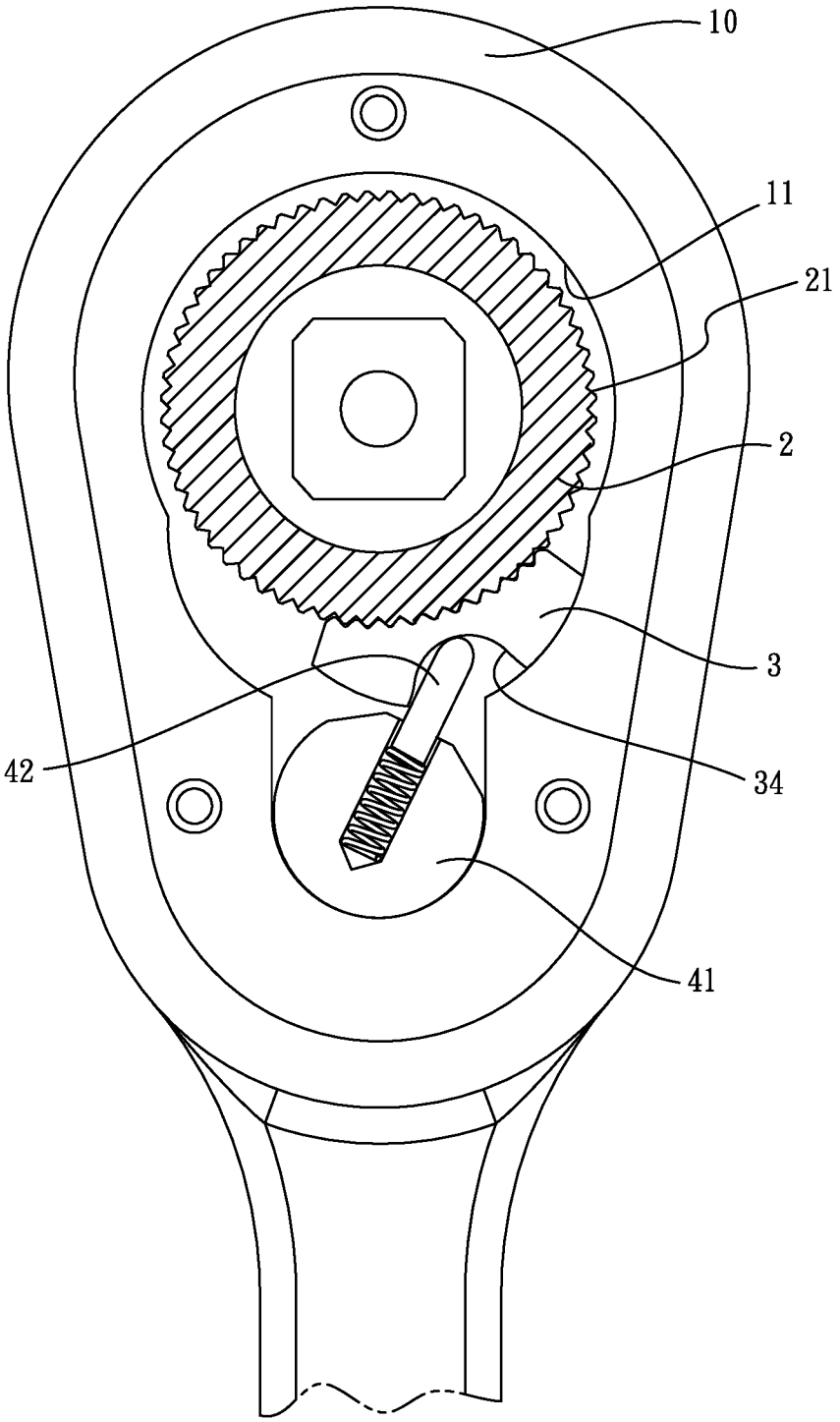
FIG. 4 is a top view of the ratchet wrench of the present invention, showing the switch assembly being turned to the first position.

Referring to FIGS. 1-7, a ratchet wrench in accordance with a preferred embodiment of the present invention comprises a wrench body 1, a ratchet gear 2, a pawl 3 and a switch assembly 4. The wrench body 1 has a head 10 at one end thereof. The head 10 defines a cavity 11, a first compartment 12 and a second compartment 13 therein. The first compartment 12 intercommunicates the cavity 11 and the second compartment 13, as shown in FIG. 1. The ratchet gear 2 is rotatably disposed in the cavity 11 of the wrench body 1 and defines a plurality of ratchet teeth 21. Each of the ratchet teeth 21 has two opposite tooth faces.

Figure 5:
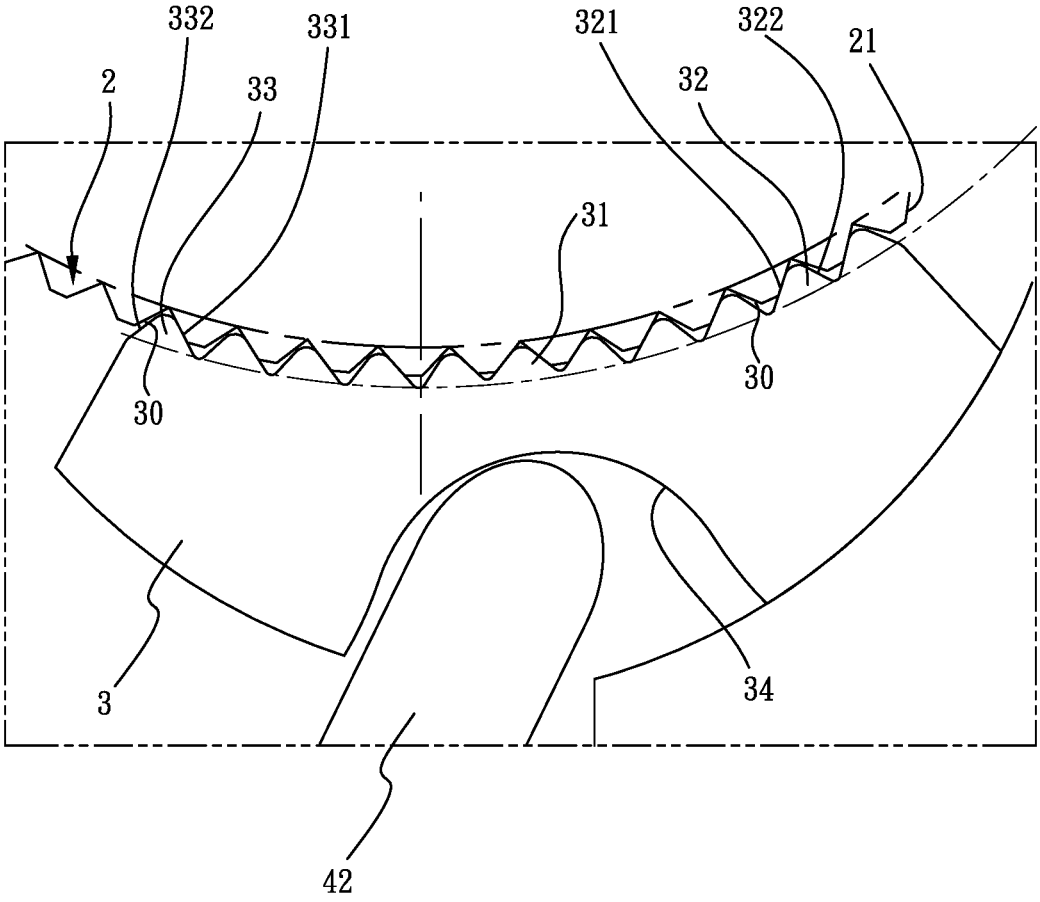
FIG. 5 is a partial enlarged view of FIG. 4.
Figure 6:
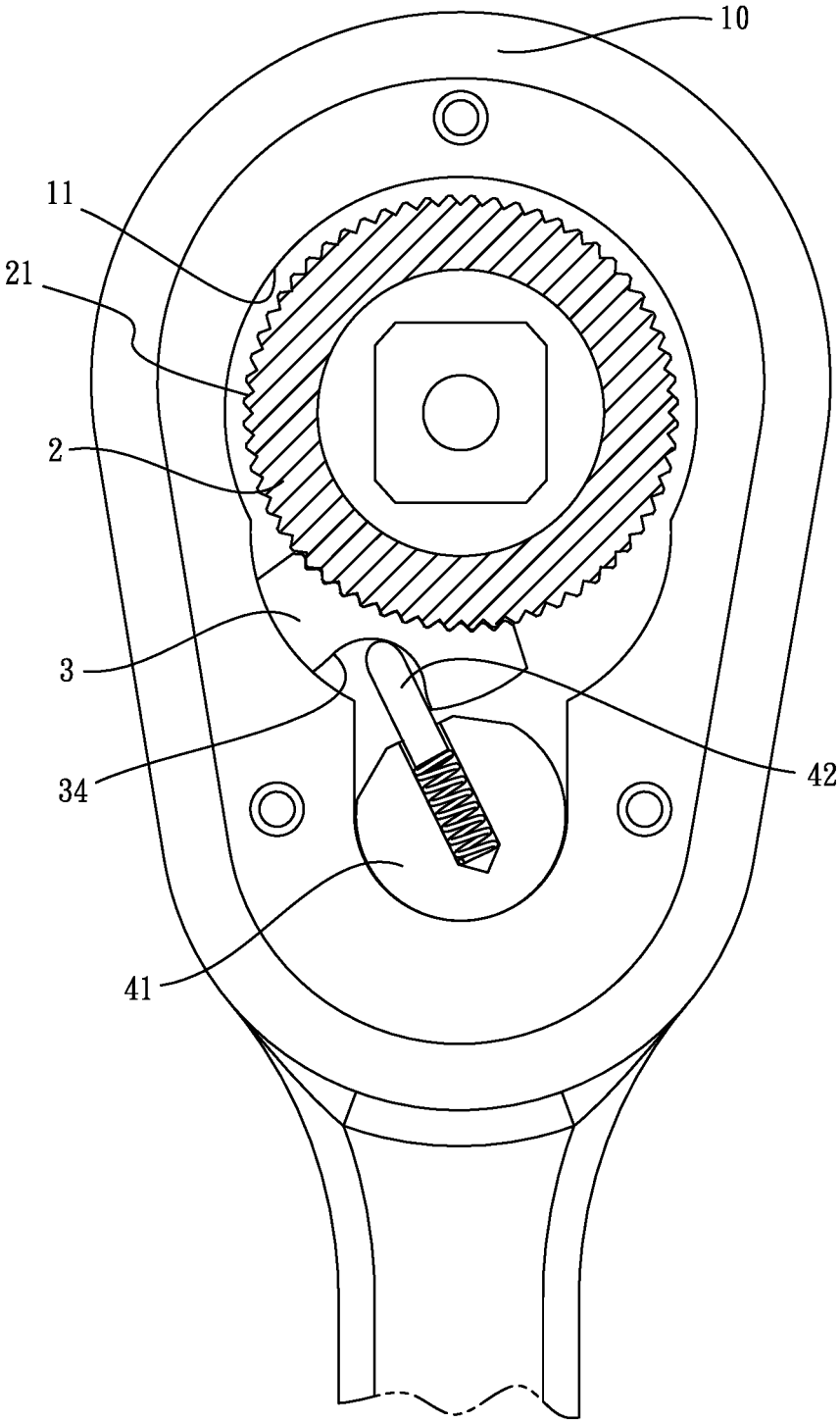
FIG. 6 is a top view of the ratchet wrench of the present invention, showing the switch assembly being turned to the second position.
Figure 7:
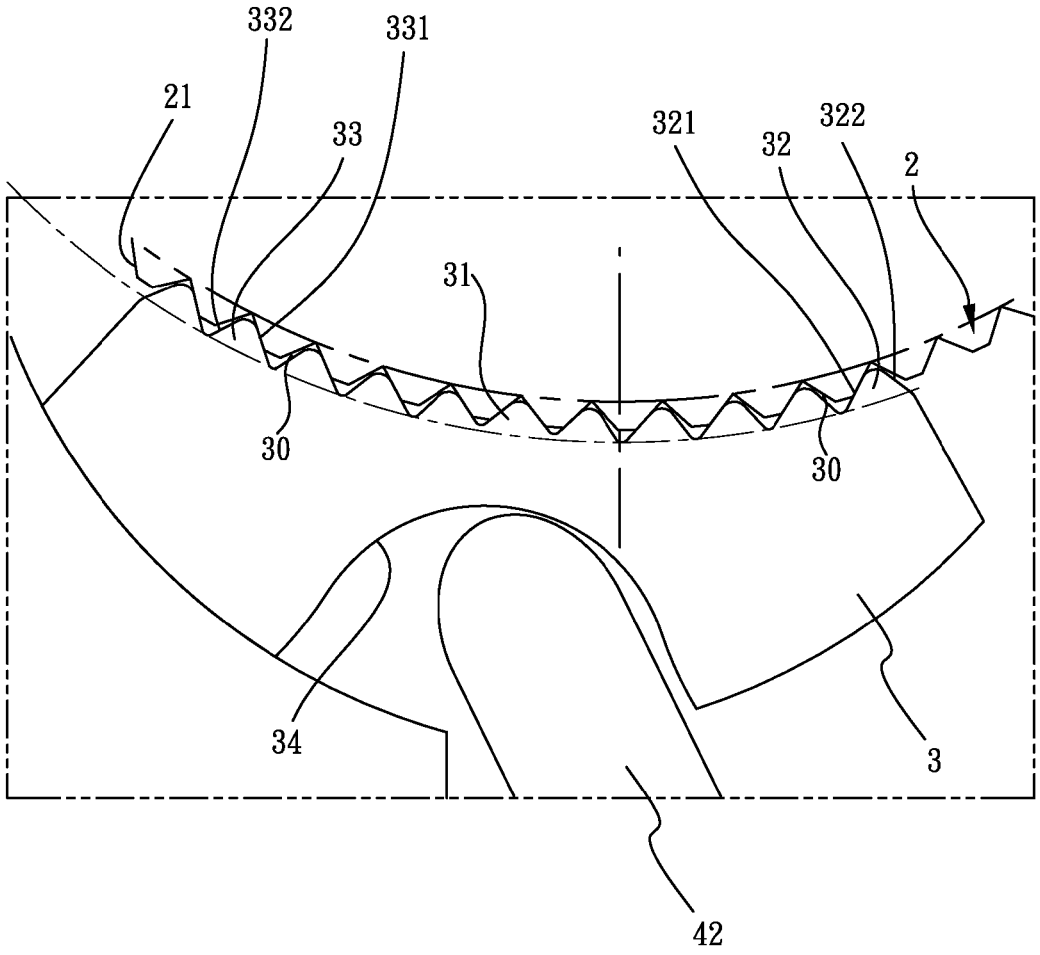
FIG. 7 is a partial enlarged view of FIG. 6.

The pawl 3 is movable in the first compartment 12 of the wrench body 1 between a firs position (FIGS. 4-5) and a second position (FIGS. 6-7). The pawl 3 defines a central tooth 31, a plurality of first sub teeth 32 and a plurality of second sub teeth 33 in a concave surface thereof which is located at the front side of the pawl 3 and faces the ratchet gear 2. A recess 34 is defined in the rear side of the pawl 3 and located corresponding to the switch assembly 4. The first sub teeth 32 and the second sub teeth 33 are respectively disposed at opposite sides of the central tooth 31. Referring to FIG. 5 and FIG. 7, the central tooth 31 is fully engaged with two adjacent ratchet teeth 21 of the ratchet gear 2 while two side faces of the central tooth 31 are respectively abut against opposing tooth faces of the two adjacent ratchet teeth 21. Specifically, each of the first and second sub teeth 32, 33 defines an inner side face 321, 331 closer to the central tooth 31 and an outer side face 322, 332 opposite to the inner side face 321, 331. The inner side face 321, 331 abuts against opposing tooth face of the ratchet gear 2. Particularly, the outer side face 322, 332 and opposing tooth face of the ratchet gear 2 are spaced apart in a distance 30. Referring to FIGS. 4-7, the switch assembly 4 is movably disposed in the second compartment 13 of the wrench body 1 for driving the pawl 3 to switch between the first position and the second position.

Under this arrangement, the distance 30 is defined between the respective outer side face 322, 332 of each of the first and second sub teeth 32, 33 and the respective opposing tooth face of the ratchet gear 2, as shown in FIG. 5 and FIG. 7. In other words, the first sub teeth 32 and the second sub teeth 33 each engages with the respective ratchet tooth 21 of the ratchet gear 2 by only one side face. Therefore, the ratchet gear 2 could be smoothly rotatable relative to the pawl 3; besides, the pawl 3 could also be smoothly switched between the first position and the second position to prevent each of the first and second sub teeth 32, 33 from being worn easily during the operation.

Figure 8:
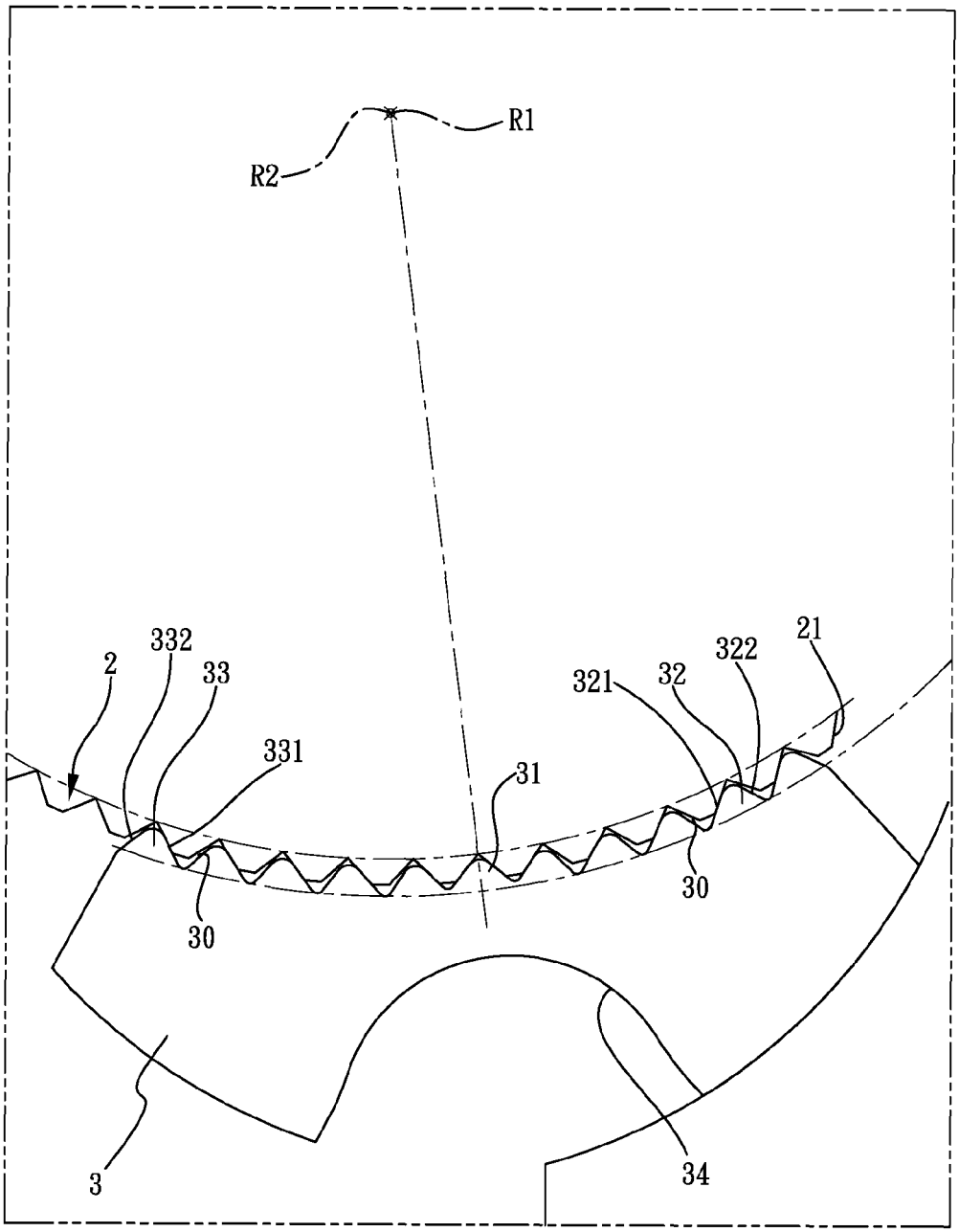
FIG. 8 shows that the center of the concave surface of the pawl and the center of the ratchet gear are located on the same line that passes through the center of the central tooth of the pawl.

Referring to FIG. 8, the curvature of the concave surface of the pawl 3 is defined such that the first sub teeth 32 and the second sub teeth 33 are located symmetrical relative to the central tooth 31. Furthermore, the curvature of the concave surface of the pawl 3 and the curvature of the outer periphery of the ratchet gear 2 are the same, which means that the center R1 of the concave surface of the pawl 3 and the center R2 of the ratchet gear 2 are located on a common line that passes through the center of the central tooth 31 of the pawl 3. Accordingly, there is no radial distance as disclosed in above-mentioned analysis regarding to the disclosure of US 2004/0083860 to Arnold et al.

Specifically, the inner side faces 321, 331 of the first and second sub teeth 32, 33 are slightly larger than the outer side faces 322, 332 of the first and second sub teeth 32, 33 respectively, as shown in FIG. 5 or FIG. 7. Furthermore, tips of the central tooth 31, the first sub teeth 32 and the second sub teeth 33 of the pawl 3 are rounded slightly. Tips of the ratchet teeth 21 are flat. As shown in FIG. 1, the switch assembly 4 has a switch lever 41 and an elastic driving member 42. The switch lever 41 is operable to have the elastic driving member 42 abut against a wall of the recess 34 of pawl 3 for selectively pushing the pawl 3 to engage with the ratchet gear 2 and to control an active direction of the ratchet gear 2.

Although embodiments of this invention have been fully described with reference to the accompanying drawings, it is to be understood that various modifications can be made by those skilled in the art without departing from the scope of the invention as hereinafter claimed.

What is claimed is:

1. A ratchet wrench comprising:

a wrench body having a head at one end thereof, the head having a cavity, a first compartment and a second compartment therein, the first compartment intercommunicating the cavity and the second compartment;

a ratchet gear rotatably disposed in the cavity of the wrench body and defining a plurality of ratchet teeth, each of the ratchet teeth defining two opposite tooth faces;

a pawl movably received in the first compartment of the wrench body, the pawl defining a central tooth, a plurality of first sub teeth and a plurality of second sub teeth in a concave surface on a front side thereof, the first sub teeth and the second sub teeth disposed at opposite sides of the central tooth, a curvature of the concave surface of the pawl being defined such that the first sub teeth and the second sub teeth are located symmetrical relative to the central tooth, a center of the concave surface of the pawl and a center of the ratchet gear being located on a common line that passes through a center of the central tooth of the pawl, the central tooth being fully engaged with two adjacent ratchet teeth of the ratchet gear and two side faces of the central tooth respectively abutting against opposing tooth faces of the two adjacent ratchet teeth, each of the first and second sub teeth defining an inner side face closer to the central tooth, and an outer side face opposite to the inner side face, the inner side faces of the first and second sub teeth being larger than the outer side faces of the first and second sub teeth respectively, when the central tooth is fully engaged with two adjacent ratchet teeth of the ratchet gear, the inner side face abuts against an opposing tooth face of the ratchet gear, and the outer side face and opposing tooth face of the ratchet gear are spaced apart by a distance; and a switch assembly movably disposed in the second compartment of the wrench body for driving the pawl to engage with the ratchet gear.

2. The ratchet wrench of claim 1, wherein the pawl defines at a top thereof a concave surface of a curvature corresponding to the ratchet gear and a recess corresponding to the switch assembly.

3. The ratchet wrench of claim 1, wherein tips of the central tooth, the first sub teeth and the second sub teeth of the pawl are rounded.

4. The ratchet wrench of claim 1, wherein tips of the ratchet teeth are flat.

5. The ratchet wrench of claim 2, wherein the switch assembly has a switch lever and an elastic driving member; and the switch lever is operable to have the elastic driving member abut against a wall of the recess of pawl for selectively driving the pawl to engage with the ratchet gear and to control an active direction of the ratchet gear.

* * * * *